US011470972B2

(12) United States Patent
Trencanskÿ

(10) Patent No.: US 11,470,972 B2
(45) Date of Patent: Oct. 18, 2022

(54) DYNAMIC-DIRECTIONAL SEAT PAD

(71) Applicant: Martin Trencanskÿ, Modrice (CZ)

(72) Inventor: Martin Trencanskÿ, Modrice (CZ)

( * ) Notice: Subject to any disclaimer, the term of this patent is extended or adjusted under 35 U.S.C. 154(b) by 668 days.

(21) Appl. No.: 16/315,953

(22) PCT Filed: Jul. 11, 2017

(86) PCT No.: PCT/IB2017/054167
§ 371 (c)(1),
(2) Date: Jan. 7, 2019

(87) PCT Pub. No.: WO2018/011707
PCT Pub. Date: Jan. 18, 2018

(65) Prior Publication Data

US 2019/0254434 A1 Aug. 22, 2019

(30) Foreign Application Priority Data

Jul. 12, 2016 (CZ) ..... CZ2016-32554 U

(51) Int. Cl.

| | |
|---|---|
| ***A47C 7/02*** | (2006.01) |
| ***A61G 5/10*** | (2006.01) |
| ***A61G 15/00*** | (2006.01) |
| ***A61H 1/00*** | (2006.01) |
| ***A61G 7/057*** | (2006.01) |

(52) U.S. Cl.
CPC ..... *A47C 7/021* (2013.01); *A61G 5/1045* (2016.11); *A61G 15/007* (2013.01); *A61H 1/006* (2013.01); *A61H 1/008* (2013.01); *A61G 7/05769* (2013.01); *A61G 2210/10* (2013.01)

(58) Field of Classification Search
CPC ..... A47G 9/1027; A63B 23/04; A47C 7/021; A47C 7/142; A61H 1/006; A61H 1/008; A61G 15/007; A61G 2210/10; A61G 7/05769; A61G 5/1045
USPC ..... D6/601
See application file for complete search history.

(56) References Cited

U.S. PATENT DOCUMENTS 3,987,506 A * 10/1976 Markwitz ..... A61H 37/00 601/149
4,405,129 A * 9/1983 Stuckey ..... A63B 21/0085 482/112
5,845,352 A * 12/1998 Matsler ..... A61G 5/1043 5/654
6,973,690 B2 * 12/2005 Muci ..... A47C 27/081 5/644

(Continued)

FOREIGN PATENT DOCUMENTS

CA 2592512 A1 11/2003
CN 201822431 U1 * 5/2011 ..... A47G 9/10

(Continued)

OTHER PUBLICATIONS

CN 201822431 U1 English Translation of Abstract (Year: 2011).*

(Continued)

*Primary Examiner* — Eric J Kurilla
*Assistant Examiner* — Amanda L Bailey
(74) *Attorney, Agent, or Firm* — Hovey Williams LLP

(57) ABSTRACT

A dynamic-directional seat pad which contains an inflating element (1), wherein a plan view of the inflatable element (1) contains a back side (4), concave sides (2) and a concave front side (3).

3 Claims, 6 Drawing Sheets

(56) References Cited

U.S. PATENT DOCUMENTS

| | | | | |
|---|---|---|---|---|
| 7,412,738 | B2 * | 8/2008 | Chaffee | A47C 20/027 5/655.3 |
| 2013/0318723 | A1 * | 12/2013 | Li | A47C 27/086 5/654 |
| 2014/0054948 | A1 * | 2/2014 | Bachar | A47C 7/021 297/452.48 |
| 2015/0061346 | A1 * | 3/2015 | Featherstone | A47C 7/021 297/452.41 |
| 2015/0366368 | A1 * | 12/2015 | Cheng | A47C 7/021 5/644 |
| 2017/0150819 | A1 * | 6/2017 | Jones | A47C 7/18 |

FOREIGN PATENT DOCUMENTS

| | | | |
|---|---|---|---|
| CN | 201870254 | U | 6/2011 |
| CN | 204120606 | U | 1/2015 |
| CZ | 10502 | U1 | 10/2000 |
| GB | 2516458 | A | 1/2015 |

OTHER PUBLICATIONS

International Search Report from Corresponding PCT/IB2017/054167 dated Oct. 9, 2017 (2 pages).
International Search Report and Written Opinion from Corresponding PCT/IB2017/054167 dated Oct. 9, 2017 (19 pages).

* cited by examiner

DYNAMIC-DIRECTIONAL SEAT PAD

RELATED APPLICATIONS

This application is the National Stage of International Patent Application No. PCT/IB2017/054167, filed Jul. 11, 2017, which is hereby incorporated herein by reference in its entirety, and which claims priority to Czech Patent Application No. CZ 2016-32554U, filed Jul. 12, 2016, which is also incorporated herein by reference in its entirety.

TECHNICAL FIELD

The invention relates to a dynamic-directional seat pad.

BACKGROUND ART

Sitting on the chair causes a static overload of the spine leading to the degradation of the intervertebral discs and the atrophy of the stabilizing muscles, especially in the spine and abdomen.

The seat pads are known from the prior art but they do not solve the dynamic-directional movements. These pads are trying to be balance in that way that they create an unstable area by inflating. During sitting, the pad forces the user to balance such instability and thus engage the limited types of muscles.

However, these pads do not solve problems with long-term sitting, they do not take into account the health condition of the users and the like. Concurrently, there is a requirement for increase efficiency of the above mentioned pads, in particular in terms of their effect on body posture of the user, in terms of the type of muscles involved in the balancing the instability of the pad and in terms of the direction of the created muscular load.

Such balance pad is disclosed, for example, in the utility model CZ10502U1, the subject-matter of which is a two-chamber dynamically unstable pad consisting of two chambers arranged horizontally one above the other and filled with gas which are gas-tightly interconnected in their central areas and at the connection point a passage for the compressed gas is formed. At least one pillow is provided with a pressure valve. The pad is designed both for sitting and standing.

The patent application GB2516458A discloses a support cushion which consists of two air-tight support portions. The first support portions comprises a first chamber and a second chamber linked such that air can flow between them. The second support portion comprises a further chamber wherein external pressure on the first chamber results in air flow between it and the second chamber, but no flow between it and the further chamber. The chambers may have air retention means in them, such as sponge or polyurethane foam. The support pillow is designed for use on wheelchairs to prevent pressure sores.

The patent application CA 2592512 A1 discloses a multilayer cushion having a shaped base on which is positioned a resilient cushioning layer. The shaped base is constructed from a supportive foam and has front and lateral bolsters. The cushioning layer is an inflatable air cell cushion having a flexible base and an array of individual air cells arranged in the rows across the flexible base. The cushion is designed for orthopaedic wheelchairs or other chair or seat cushions.

The said solutions reduce the pressure on the stressed areas of the tissue and distribute it evenly over a larger area but they do not allow the load to be directed into the desired muscles of the human body.

NATURE OF INVENTION

The nature of the invention of a dynamic-directional pad lies in creating muscle work by instability of the pad itself and concurrently by targeted positioning of the body during sitting on the pad. This leads to the direction of muscular activity into the relevant muscle groups of the human body.

The task defined in the preceding part is solved by the dynamic-directional seat pad which contains an inflatable element the plan view of which contains a back side, concave lateral sides and a concave front side. The back side is preferably straight or slightly convex. The inflatable element has rounded corners which is advantageous in terms of comfort of the user.

It is also preferred that the concave front side has the radius of curvature of 100 to 150 mm and/or the concave lateral sides have the radius of curvature of 150 to 250 mm, in particular of 190 to 210 mm.

In the preferred embodiment, the maximum width of the front part of the plan view of the pad is greater than the maximum width of the back part which is greater than the maximum width of the central part. In a particularly preferred embodiment which takes into account the conventional dimensions of the human body skeleton, the plan view of the inflatable element has the maximum width of 38 to 42 cm in the front part, the maximum width of 36 to 40 cm in the back part, and the maximum width of 33 to 37 cm in the central part.

The inflatable element preferably contains at least one inflatable valve.

The inflatable element may be preferably divided into at least two chambers which are interconnected through at least one release opening.

In one preferred embodiment, the inflatable element comprises a pair of chambers which are arranged in the plan view one above the other, wherein the plan view of both chambers is the same. The inflatable element preferably contains exactly one release opening or three release openings. If there is only release opening, it is preferably arranged near the back side of the plan view of chambers but with the spacing therefrom, on the central line passing through the concave lateral sides. If the inflatable element contains three release openings, one release opening is preferably arranged near the front side of the plan view of the chambers, but with spacing therefrom, on the central line passing between the concave lateral sides, while the other two release openings are arranged symmetrically with regard to the central line near the back side but with spacing therefrom.

In another preferred embodiment, the inflatable element contains a central reduced area passing along the central line and at least one chamber is arranged between the central reduced area and each of the concave lateral sides. Especially preferably, between the central reduced area and each of concave lateral sides is arranged a pair of chambers which are arranged one above the other, have the same plan view and are interconnected through the release opening which is preferably arranged at the front part. It is also preferred that such inflatable element is at its back part provided with a pair of welds to form a recess in the inflated state of the inflatable element, wherein the welds are preferably arranged symmetrically with regard to the central line.

In even another preferred embodiment, the inflatable element contains a pair of chambers, each of which is arranged along one concave lateral side, wherein the release opening between them is arranged near the back side of the plan view of the inflatable element, while at the front part and the central part of the plan view is arranged the central reduced area between the chambers.

The pad preferably comprises a cover within which the inflatable element is placed. In a preferred embodiment, the cover is made of upholstering fabric at its upper side, of the rubber or PVC film at its bottom side and at the lateral sides it is provided with a peripheral rim. Between the cover and the inflatable element can be arranged a layer of thermal-insulating foam.

The shape of the inflatable element, its size and optionally number and positioning of the release openings and optionally of the fixation strips ensures direction of muscle work.

The present invention has higher effects compared to the pads from the prior art. To prove this fact, measurements were performed on the left and right gracilis muscle (musculus gracilis). All measurements were performed under the same conditions, i.e. during the same length of time and in the same laboratory environment. For all measurements, sitting at the table and computer work (office functions) were selected as the type of activity. The total duration of the activity was 4 minutes, of which a 2-minute section was selected during which the bioelectric activity (EMG-RMS) data were collected in the said muscle unit.

In one embodiment of the present invention, the EMG-RMS value was 4,164 μV for the right muscle and 4,366 μV for the left muscle, wherein the total EMG-RMS value was 4,265 μV. On the other hand, for the compared known seat pad the EMR-RMS value was 4,152 μV for the right muscle and 4,194 μV for the left muscle, wherein the total EMG-RMS value was 4,179 μV.

In another embodiment of the present invention, the EMG-RMS value was 3,791 μV for the right muscle and 4,733 μV for the left muscle, wherein the total EMG-RMS value was 4,262 μV. On the other hand, for the compared known seat pad, the EMG-RMS value was 3,797 μV for the right muscle and 4,162 μV for the left muscle, wherein the total EMG-RMS was 3,965 μV.

BRIEF DESCRIPTION OF DRAWINGS

The invention is further disclosed in more detail by means of exemplary embodiments shown in the drawings, in which FIG. 5 is the schematic view of the inflated inflatable element for the first or second exemplary embodiment showing the two chambers arranged one above the other, and.

EXAMPLES OF EMBODIMENTS

The pad comprises the cover and the inflatable element 1. The inflatable element 1 is arranged inside the cover and comprises the inflatable insert inserted into the cover. The cover of the pad according to the present invention has the same shape as the inflatable element 1. Additionally, the pad can contain the layer of the thermal-insulating foam arranged between the cover and the inflatable element 1 and having the same plan view as the cover of the pad.

In terms of dimensions, the cover is adequately larger so that the inflatable element 1 could be put into it and stitched inside, optionally also with the same (in terms of plan view) formed thermal-insulating foam, and the same time so that the cover adheres to the content (the inflatable insert and optionally the thermal-insulating foam) inserted into it. The layer from the thermal-insulating foam has adequately smaller dimensions than the cover of the pad to fit into the cover.

Figure 1:
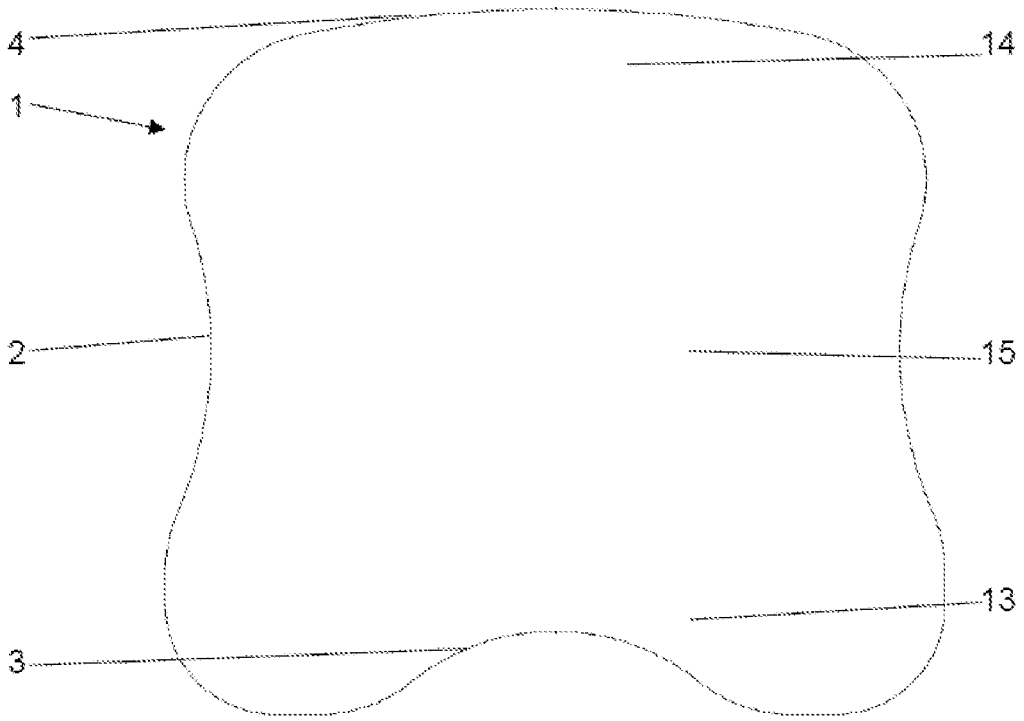
FIG. 1 is the plan view of the inflatable element for the first exemplary embodiment of the pad.

FIG. 1 shows the plan view of the first exemplary embodiment of the inflatable element 1 for the dynamic-directional seat pad according to this invention. The plan view is substantially rectangular (or slightly trapezoidal) with rounded corners but the lateral sides 2 are concave having the radius of curvature 200 mm and the front side 3 is also concave having the radius of curvature 133 mm. Due to the concave lateral sides 2, the inflatable element 1 in the plan view is narrowed at the front part 15 or it measures 380 mm at the widest point of the back part 14, 400 mm at the widest point of the front part 13 and 350 mm at the narrowest point of the central part 15. Such shape is advantageous from anatomical point of view because the pelvic bone itself is supported during sitting on this pad, while the hips or articulations of the femurs are disposed at least partially outside the pad in areas closely adjacent to the concave lateral sides 2. This contributes to the unintentional straightening of the pad user during sitting and to creating swinging movements to left and right and to front and back.

The back side 4 of the plan view of the inflatable element 1 can be straight or slightly convex.

Figure 2:
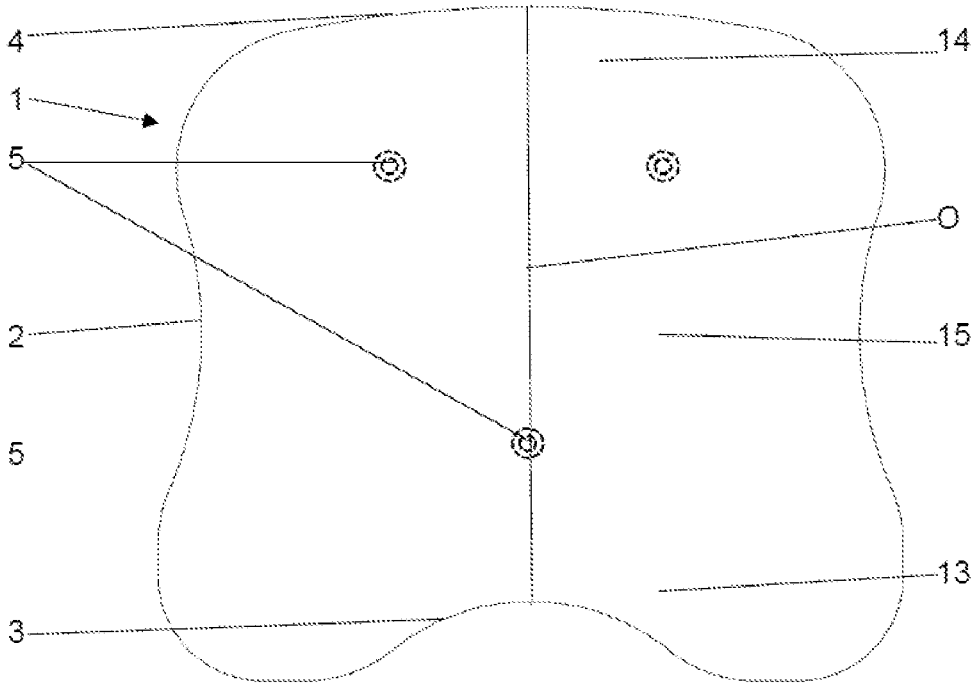
FIG. 2 is the plan view of the inflatable element for the second exemplary embodiment.

The inflatable element 1 of FIG. 2 differs from the inflatable element 1 of FIG. 1 in that it consists of two-chambers, wherein both chambers have the above mentioned plan view and are arranged one above the other and are interconnected through the release openings 5 (which are not visible from the top view of the inflatable element 1 but are illustrated in the drawings with an interrupted line). One release opening 5 is arranged in the area of the central line O between the concave lateral sides 2 and on the boundary between the front part 13 and the central part 15, or approximately on the border of the first third of the front part 13 and the central part 15. The other two release openings 5 are arranged in the back part 14 symmetrically with regard to the central line O passing along the concave lateral sides 2.

Alternatively, the inflatable element 1 can contain just one release opening 5 which is arranged near the back side 4 of the plan view of the chambers but with spacing therefrom, on the central line O passing between the concave lateral sides 2.

The diameter of the release openings 5 is preferably 7 to 12 mm, the most preferably 10 mm. The maximum height (the height in the direction perpendicular to the plan view shown in the drawing) of the inflatable element 1 from the FIG. 1 after inflating is 50 to 180 mm.

The pad with the inflatable element 1 from the embodiment of the FIGS. 1 and 2 is particularly suitable for creating muscle activity and direction of this activity into deep stabilizing muscles of the back and abdomen and gluteal muscles.

Figure 3:
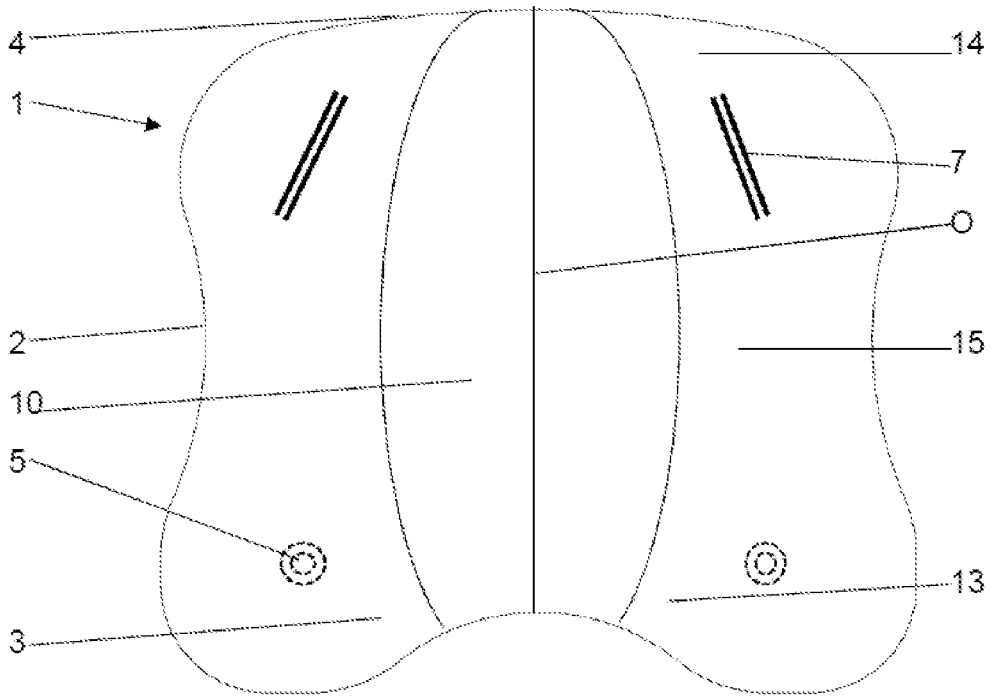
FIG. 3 is the plan view of the inflatable element for the third exemplary embodiment.

The embodiment of the inflatable element 1 shown in the FIG. 3 differs from the embodiment of the FIG. 1 or 2 in particular by containing the central reduced area 10 arranged at both sides along the central line O. The central reduced area 10 can have width preferably of 110 mm in the front part 13 to 170 mm in its widest area arranged in the central part 15.

Between the concave lateral sides 2 and the central part 10, a pair of chambers, identical in the plan view, is arranged one above the other. These chambers are interconnected through the release openings 5 arranged in the front part 13 symmetrically with regard to the central line O. In the back part 14, the chambers are secured by welds 7 which after inflating of the chamber form in the inflatable element 1 recesses which are symmetrical with regard to the central line O. The welds 7 are linear, doubled and pass (in the plan view) obliquely with regard to the central line O so that the end of the weld 7 which is closer to the back side 2 is also closer to the central line O than the second end of the weld 7.

The central area 10 is in the side view lowered which is achieved either in such way that the central area 10 is not inflatable at all and merely constructively connects the inflatable lateral areas, or the central area 10 is inflatable and is interconnected always with one of the chambers in the lateral area and after inflating its height is lower than that of the lateral areas.

The diameter of the release openings 5 is preferably 7 to 12 mm, the most preferably 10 mm.

The maximum height (the height in the direction perpendicular to the plan view shown in the drawing) of the inflatable element 1 of the FIG. 3 after the inflating is 50 to 180 mm.

The pad with the inflatable element 1 from the embodiment of the FIG. 3 is particularly adapted for creating muscle activity and direction of this activity into the deep muscles of the pelvic floor and abdomen and gluteal muscles. Its use is especially suitable for women with gynaecological or urological problems and after gynaecological or urological surgery.

Figure 4:
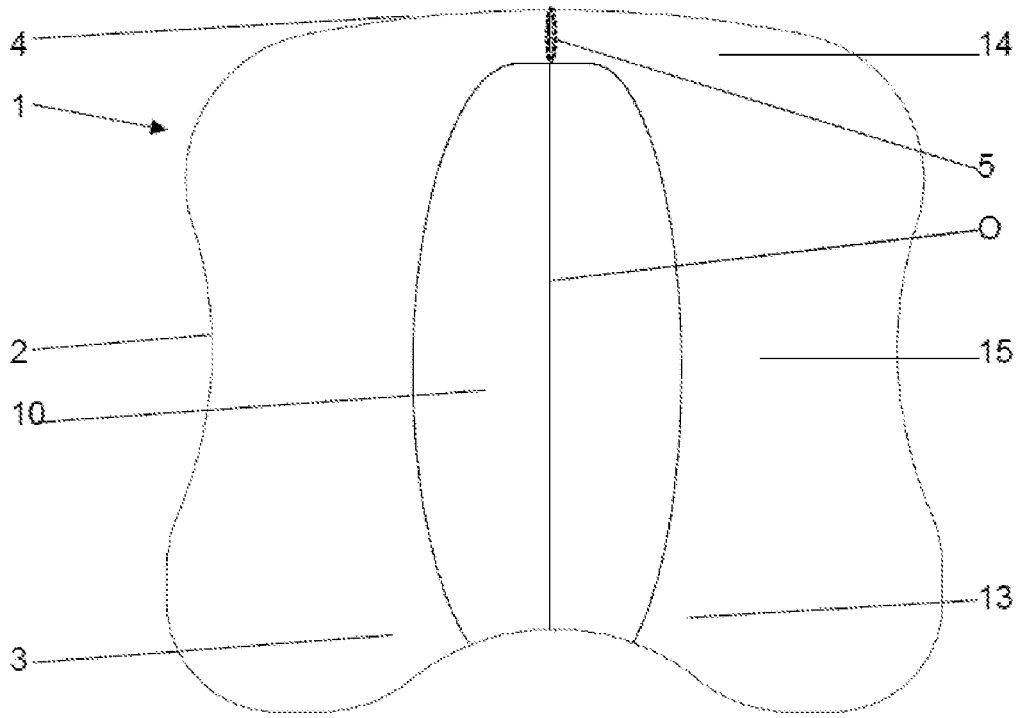
FIG. 4 is the plan view of the inflatable element for the fourth exemplary embodiment.

In the embodiment of the FIG. 4, the inflatable element 1 contains a pair of chambers and the central reduced area 10 between them. Each of the chambers is thus arranged between the concave lateral side 2 and the central reduced area 10 wherein the chambers are interconnected through the release opening 5 arranged in the back part 14 on the central line O. Thus the chambers are arranged in the plan view not one above other but side by side.

The diameter of the release openings 5 is preferably 20 to 30 mm, the most preferably 25 mm.

The maximum height (the height in the direction perpendicular to the plan view shown in the drawing) of the inflatable element 1 of the FIG. 4 after inflating is 50 to 140 mm.

Figure 5:
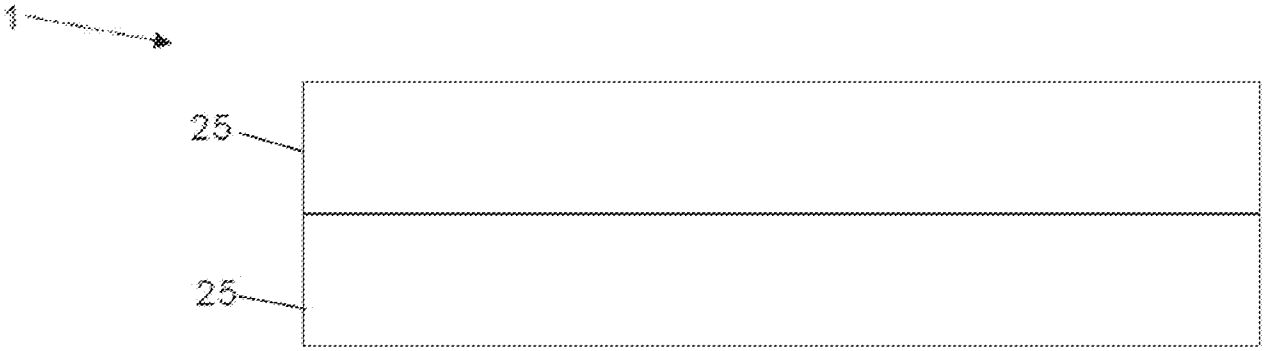
Figure 6:
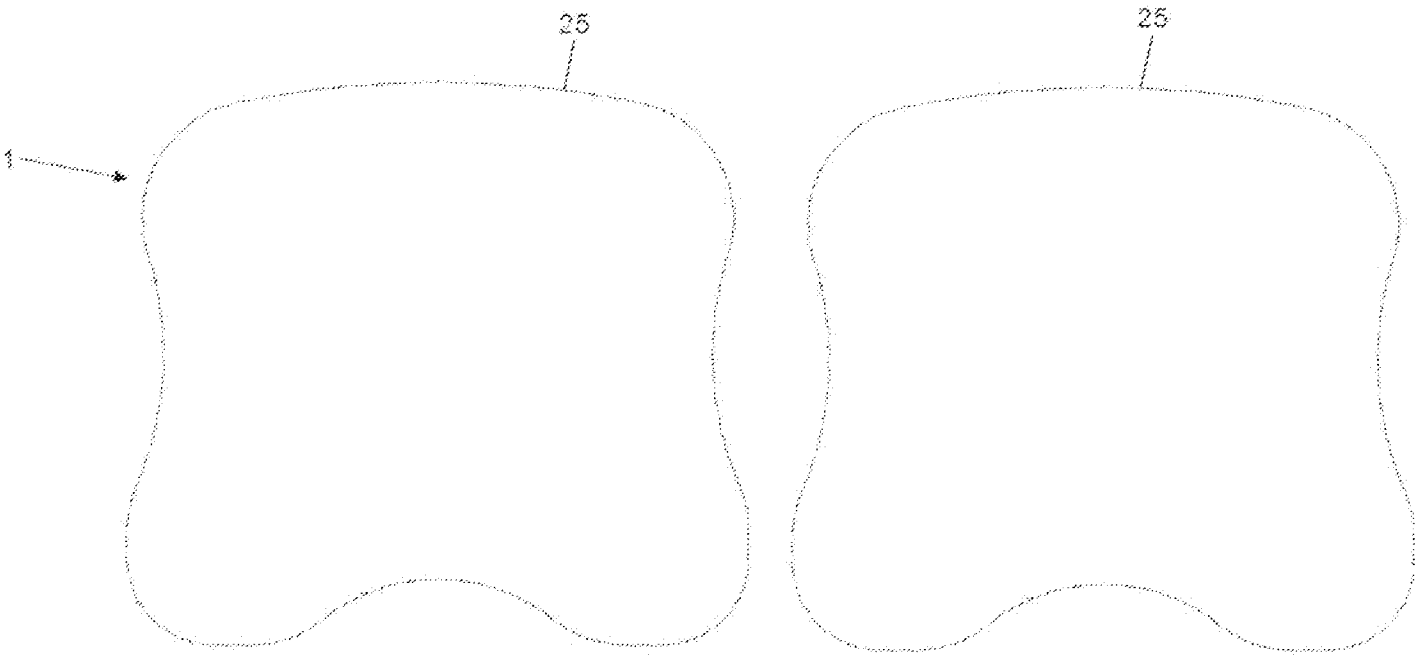
FIG. 6 is the plan view of the two chambers of the inflatable element having the same plan shape and positioned side by side.

The pad with the inflatable element 1 from the embodiment of the FIG. 5, which depicts a schematic view of FIG. 1, can be inflated such that the chambers 25 are arranged one above the other, wherein the plan view of both chambers is the same (as depicted in FIG. 6).

In spite of the fact that several exemplary embodiments have been presented, it is clear, that further possible alternatives exist to these embodiments. Therefore the scope of the patent is not limited to these exemplary embodiments but is given by the definition of the accompanying claims.

The invention claimed is:

1. A dynamic-directional seat pad, wherein the pad contains an inflating element, wherein a plan view of the inflatable element contains a straight or slightly convex back side, concave lateral sides, and a concave front side, wherein the concave front side has a radius of curvature of 100 to 150 mm and/or the concave lateral sides have a radius of curvature of 150 to 250 mm, wherein the plan view of the inflatable element has a maximum width of 38 to 42 cm in the front part, a maximum width of 36 to 40 cm in the back part and a maximum width of 33 to 37 cm in the central part, wherein the inflatable element is divided into at least two chambers which are interconnected through at least one release opening, wherein the chambers are arranged in the plan view one above the other, wherein the plan shape of both chambers is the same, and wherein the inflatable element comprises three release openings, one of which is arranged near the front side of the plan view of the chambers but with spacing therefrom, on a central line passing between the concave lateral sides, while the other two release openings are arranged symmetrically with regard to the central line near the back side but with spacing therefrom.

2. The pad according to claim 1, wherein the inflatable element has rounded corners.

3. The pad according to claim 1, wherein the maximum width of a front part of the plan view of the pad is greater than the maximum width of a back part, which is greater than the maximum width of a central part.

* * * * *